United States Patent [19]

Szent-Miklosy, Jr.

[11] 3,937,147

[45] Feb. 10, 1976

[54] PERSONALIZED RAPID TRANSIT SYSTEM

[76] Inventor: Balint Szent-Miklosy, Jr., 150 Haven Ave., Terrace 3, New York, N.Y. 10032

[22] Filed: Aug. 13, 1973

[21] Appl. No.: 388,058

[52] U.S. Cl. ..... 104/93; 104/88; 105/346; 280/33.99 R

[51] Int. Cl.[2] ..... B61D 11/00; B61B 3/00

[58] Field of Search..... 104/88, 118, 121, 89–94, 104/124, 18, 20, 88; 105/331, 345, 150, 153, 329; 280/33.99 R, 33.99 H, 33.99 S, 33.99

[56] References Cited

UNITED STATES PATENTS

| | | | |
|---|---|---|---|
| 871,419 | 11/1907 | Knoll | 105/346 |
| 3,094,079 | 6/1963 | Greil | 105/329 S |
| 3,347,173 | 10/1967 | Carlevaro | 104/173 ST |
| 3,353,503 | 11/1967 | Pettit | 104/93 |
| 3,461,813 | 8/1969 | McIlvaine | 104/173 ST |
| 3,541,962 | 11/1970 | Avery | 104/94 |
| 3,813,111 | 5/1974 | Ruger | 280/33.99 R |

*Primary Examiner*—M. Henson Wood, Jr.
*Assistant Examiner*—Richard A. Bertsch
*Attorney, Agent, or Firm*—Kane, Dalsimer, Kane, Sullivan and Kurucz

[57] ABSTRACT

A personalized rapid transit system incorporating an interconnected network of rails which are supported in a predetermined three dimensional pattern. A plurality of vehicles which are each adapted to carry at least one person and have a configuration which facilitates the removable nesting of vehicles when not in use are provided. Connection and drive apparatus is on each vehicle and is connected to the network of rails so that the vehicle is suspended from the rail network and is guided and supported thereby during travel and storage.

7 Claims, 6 Drawing Figures

FIG. 1A
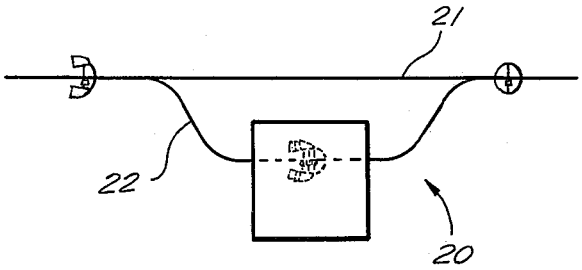
FIG. 1B
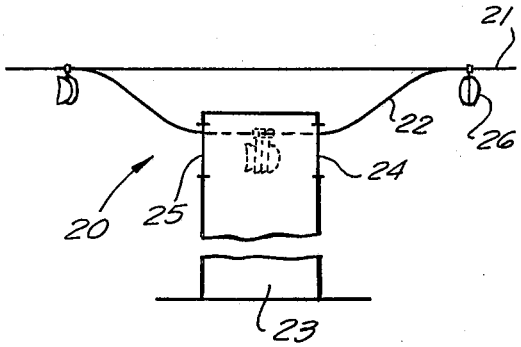
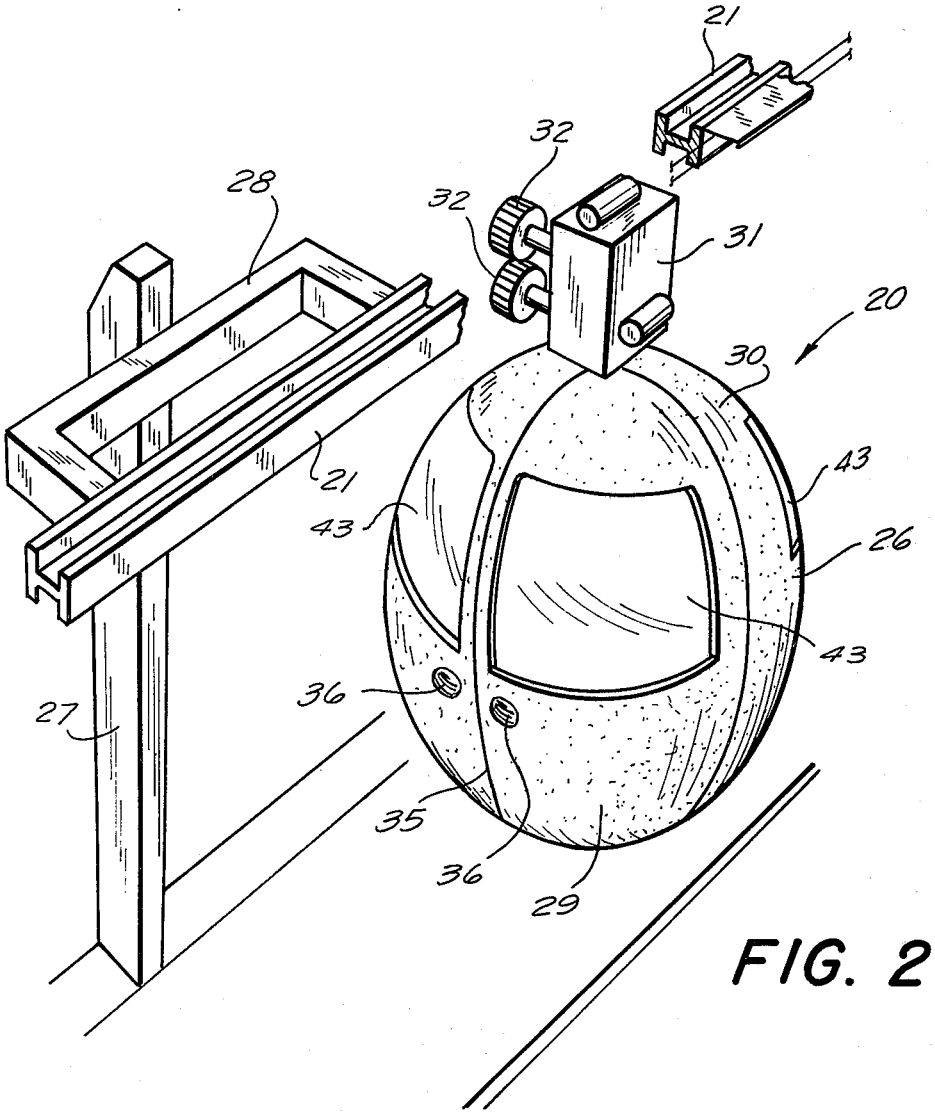
FIG. 2

PERSONALIZED RAPID TRANSIT SYSTEM

BACKGROUND OF THE INVENTION

Public transportation is in a rapidly changing state. The existing systems have shortcomings that have been readily apparent for some time. The trend in development is to the personalized service vehicle on a public scale in order to replace the private automobile with a more efficient and effective means of public transportation.

With this thought in mind, trains are outmoded in that to be profitable they have to be too big and would run less often and serve fewer people. Buses present a pollution problem, are uncomfortable, and, as with the train, every time one person gets on or off all the passengers must wait. The automobile is not acceptable because of pollution, size and occupancy rate. Therefore, a completely new system must be found, one with units smaller than a car, that gives individualized service, that is non-polluting, inexpensive to run, and frees the driver from being tied to his vehicle.

One problem that exists with all transportation systems presently envisioned relates to storage. The storage of all vehicles not in use takes up an enormous amount of real estate. Railyards, parking lots, and bus depots all exist for the sole purpose of storing empty containers side-by-side or one after the other. If, on the other hand, vehicles were designed so that one end remains open and the units could fit into one another, storage would be cut down many times over.

SUMMARY OF THE INVENTION

With the above background in mind, it is a primary objective of the present invention to provide a personal rapid transit system with individual vehicles which are adapted to nest within one another for storage purposes. The system is to be designed for three dimensional travel to maximize personal service distribution.

It is envisioned that each individual unit would be a small vehicle made out of a strong material and desirably of single piece construction. For example, transportation tested plastic with reinforcement by metal rods is one expedient. The resultant unit would be light, and therefore the future guideways would also be lighter, for they would be built in proportion to the units using them. With weight considerations in mind, it is also of note that one of the heaviest parts of any rolling stock is the axle. Therefore, to cut down weight of the vehicle, elimination of this part would be advantageous. Consequently, the present design utilizes a monorail overhead system which eliminates the heaviest and bulkiest components of present transportation systems provides a container that is light, colorful, and vandal-proof and fits easily into one another of the same design. The unit can be stored in such a manner that in the space required by a present day car with a capacity of six people, 20 of the present units can be stored with a carrying capacity of 50 people.

Each vehicle or capsule is designed to maximize utilization of available seating space without having excess space. With this in mind, taking into account both technical and social considerations, the ultimate configuration would appear to be a unit with a two-seat capacity with the possibility of seating a child between the two. This would give the capsule a capacity of 2.5 persons, which is believed to be satisfactory under present conditions. Naturally, this can be varied depending upon changing conditions. It is also envisioned that occasionally a larger capacity will be required in which case the capsules can be designed so that two of them could interconnect for the duration of the journey. This would result in a temporary capacity of five per unit. The system is designed so that capacity is minimized to avoid problems present in conventional systems. A consistently larger capacity makes a more expensive system and a heavier system with empty seats that would constantly have to be transported unnecessarily. Today's automobiles have to carry the back seat even though the space is rarely used. The present design is structured to avoid that problem.

The present system is designed to be basically automatic with some control given to the passenger but always doublechecked by the overall controls. With present technology, there is no reason why the entire system cannot be computerized with passenger pushbuttons available to permit deviations in travel with the acceptance of the computerized control system.

It should also be noted that in the present system, when a unit reaches its destination, it is diverted to an off-line station so as not to interfere with any of the other vehicles using the system. Once in the system, each unit travels at a preselected speed from its point of origin to destination without slowing down or in any way interfering with any of the other units in operation. The system fulfills the needs of urban environment in that it is a four dimensional one that will serve the highrise resident as well as the basement living resident at any hour of the day.

The present system has substantially no station requirements, which further cuts costs. The system is designed with a no-wait capacity, there is no need for heavy construction and expense of hard to patrol stations. In essence, there will be a station wherever the people are, mainly at sidewalk level. Each sidewalk is already a platform above a collection of pipes and machinery. Once a mechanized system is presented to transport people, it makes no sense to have them climb up or down to where the machine travels. The system is designed so that it comes to the people and picks them up where they are, at sidewalk level, at roof level, or even within a building since the unit is small enough to pass right through window spaces.

Taxi stops can be provided which would be designed with a capacity to fill the requirements of a neighborhood and several cars would be assigned to each stop on a permanent basis. This means that when a person comes to a stop, he would see several units standing there. Once the passenger gets into the first capsule, he presses the start button and if the controls permit the unit would accelerate and slip into the main system. Appropriate buttons could be provided within the overall control to permit the passenger to direct the destination of the capsule.

In regard to empty units, each stop would be designed with certain unit capacity so that when one capsule enters the station that already contains the full complement of vehicles or capsules, the automatic controls would direct the first unit in line to leave the station and travel until it reaches a station that does not have a sufficient number of empty units whereupon it would exit and wait for a passenger at that point.

The basic configuration of the system would be of a loop to maximize travel in one direction only and eliminate the dead end situation. More complex designs could provide interconnection of several loops. Another advantage of the present system is in regard to shipment of freight. The capsules could be loaded with goods, sealed and directed under automatic controls to their exact destination thereby minimizing danger of pilferage. The system for freight shipment in this manner would be quick, efficient and economical.

In summary, the method and apparatus for a personalized rapid transit system is present. The system includes an interrconnected network of rails and support means to locate the rails in a predetermined three-dimensional pattern. A plurality of vehicles are provided with each vehicle adapted to carry at least one person therein and have a configuration which facilitates the removable nesting of vehicles when not in use. Finally, conductor and drive means are provided on each vehicle and connected to the network of rails so that the vehicle is suspended from the rail network and is guided and supported thereby during travel and storage.

With the above objectives, among others, in mind, reference is had to the attached drawings.

BRIEF DESCRIPTION OF THE DRAWINGS

In the drawings:

FIG. 1*a* is a schematic top plan view of the system of the invention;

FIG. 1*b* is a schematic front elevation view thereof;

FIG. 2 is a fragmentary perspective view of a portion of the system including a vehicle mounted thereon;

DESCRIPTION OF THE PREFERRED EMBODIMENT

Figure 3:
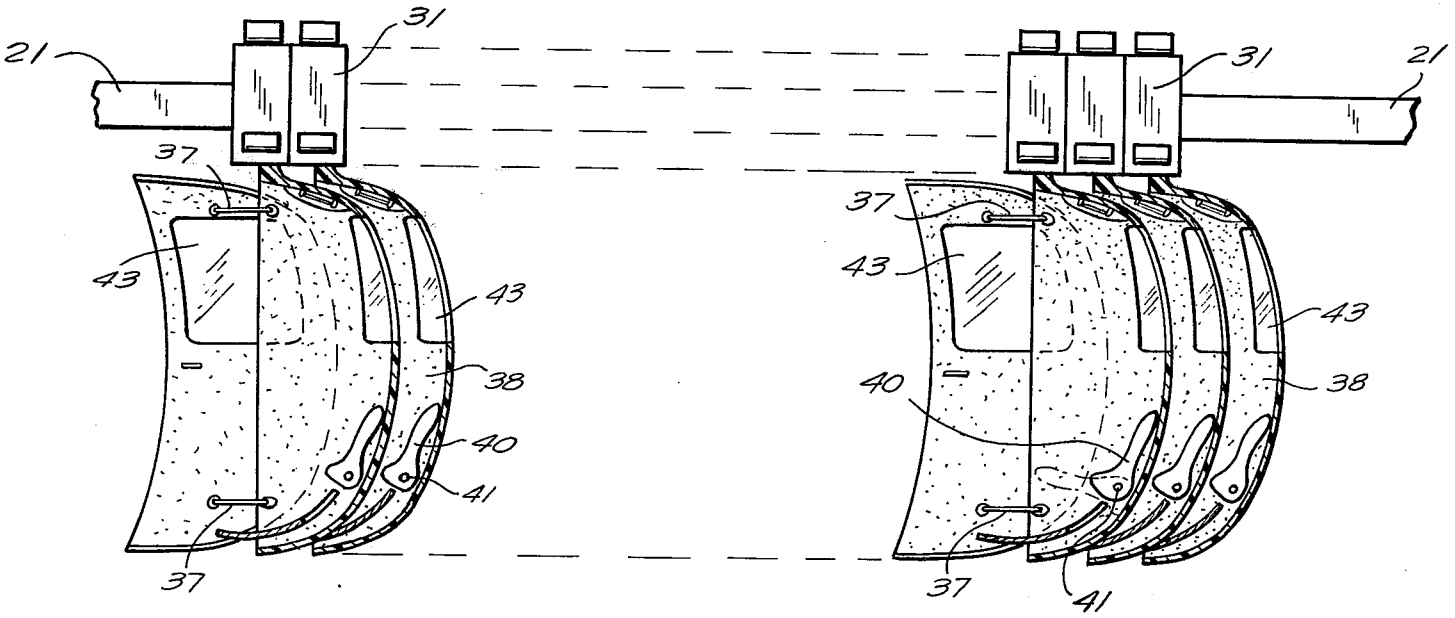
FIG. 3 is a fragmentary side elevation view thereof showing a plurality of vehicles in stacked stored condition.

FIGS. 1*a* and 1*b* show system 20 in schematic form. A main route or loop 21 is shown for main travel and a side loop or secondary rail system 22 is shown in connection at two separate points with loop 21. The loops are constructed of a supported monorail system as shown in detail in FIG. 2. Naturally, two rail systems or other known rail systems can be utilized in place of the depicted monorail system and is a matter of choice.

Side loop 22 shows the versatility of the system. Not only does it deviate from the main path of loop 21 but it is inclined to demonstrate the three dimensional feature of the system and it passes through a building 23 by entering one window 24 and exiting through an opposing window 25. As shown, the building forms a station area where a plurality of vehicles 26 are stacked for use. A passenger in capsule 26 on line 21, by executing the proper control operation, can cause vehicle 26 to deviate onto path 22 and enter building 23 through window 24. He can then press the appropriate button to stop the vehicle and exit therefrom at which time the vehicle can be stacked as shown. When someone in the building thereafter decides to use a vehicle or capsule 26 he enters the front vehicle of the stacked group and shuts the door and operates the appropriate control so that the vehicle passes through window 25 and from side loop 22 into the main loop 21 and on to its desired location.

FIG. 2 shows the specific details of system 20. Rail 21 is depicted as a typical monorail overhead structure which is adapted to be inclined at any desired angle and directed in any horizontal direction. Appropriate supports such as upright member 27 and U-shaped grasping prong 28 are dimensioned and utilized so as to support the monorail in a fixed position. Naturally the interengagement between supports 27 and 28 and rail 21 can be accomplished in a conventional fashion such as welding or bolting the elements together.

Vehicle or capsule 26 is somewhat hemispherical in configuration with the forward portion 29 being more spherical than the rear portion 30. Rear portion 30 tapers gradually toward the rear end of capsule 26 so as to provide a smaller outer dimension on the rear half 30 of vehicle 26 than the forward half 29 of the vehicle. Extending from the top of vehicle 26 is the drive and connector assembly 31 which includes appropriate drive mechanisms and also has a pair of vertically spaced engaging wheels which are dimensioned so as to track on rail 21. The shafts which are connected with wheels 32 are conventionally rotatably mounted within the drive housing 31 so that when wheels 32 are tracked on monorail 21, the drive housing 31 and capsule 26 are both suspended on monorail 21 and supported thereby.

Figure 4:
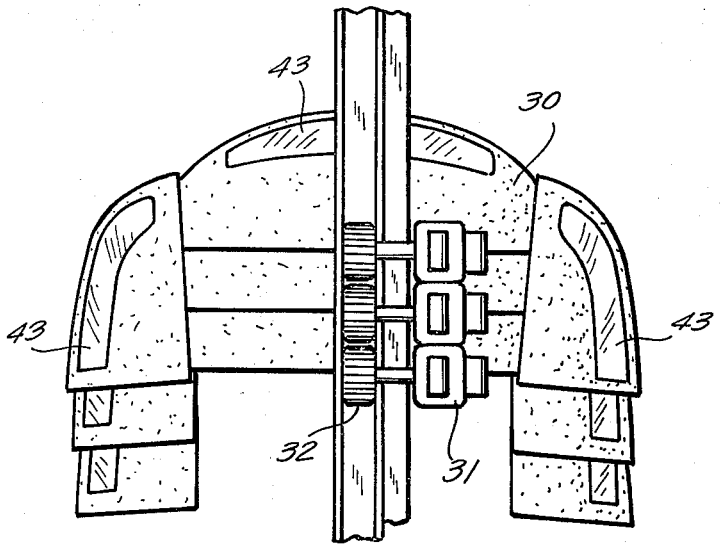
FIG. 4 is a top plan view of a fragmentary portion of the system showing a plurality of vehicles in stacked stored condition.

Each capsule or vehicle 26 is designed for specific structural purposes. These details are depicted specifically in FIGS. 3–5. The enlarged hemispherical forward portion 29 is partially constructed of a pair of opposing pivotal front doors 33 and 34 respectively. The doors are shiftable so that their adjacent edges meet when the doors are closed along a central seam 35 at which point appropriate latch mechanisms can be utilized to keep the capsule still. Adjacent to seam 35 which is formed when doors 33 and 34 are in the closed position are a pair of lights 36 mounted on the doors to facilitate operation of the vehicle at night. Each of the doors is hinged at the top and bottom to the remainder of the capsule by sliding bars 37 which are connected to the doors and are slidably mounted in the remainder of the capsule. Therefore when the doors are opened, they can be shifted rearwardly into overlapping position with respect to rear portion 30 of capsule 26 for a predetermined amount of area as depicted in FIG. 4. Sliding mechanisms 37 are of a conventional type which will permit the rotation of the doors as shown between the position indicated in FIGS. 4 and 5 and the closed position as indicated in FIG. 2.

The interior of vehicle 26 is basically in the form of a hollow chamber 38 for holding the passengers. It will be noted that all the elements of vehicle 26 are concave in configuration to maximize the size of chamber 38. As shown, and appropriate seat or bench 39 is placed within chamber 38 and is mounted to the inner walls of the capsule. As discussed above, this seating area should be sufficient to carry at least two passengers and probably have a capacity of 2.5. For nesting purposes, the seat should be located in rear portion 30 adjacent to the tapered rear side of the vehicle 26.

The structure is designed so that certain expedients are present for storing or nesting of the capsule to minimize the space required. As described above, the doors 33 and 34 are shiftable back along the outer surface of rear portion 30 in a concentric type of arrangement to provide a large open front for the vehicle. Then, as shown in FIG. 3, the lower portion 40 of seats 39 are rotatable between the substantial horizontal position and a somewhat vertical position in engagement with the back inner wall of the capsule. This is accomplished by means of pivot point 41 and serves to enlarge the chamber portion 38 within rear portion 30 during storage so that a greater portion of another vehicle can be received within the first vehicle. The storage position of seat 39 is depicted in FIG. 3 in solid lines and the operational position is depicted in dotted lines.

Figure 5:
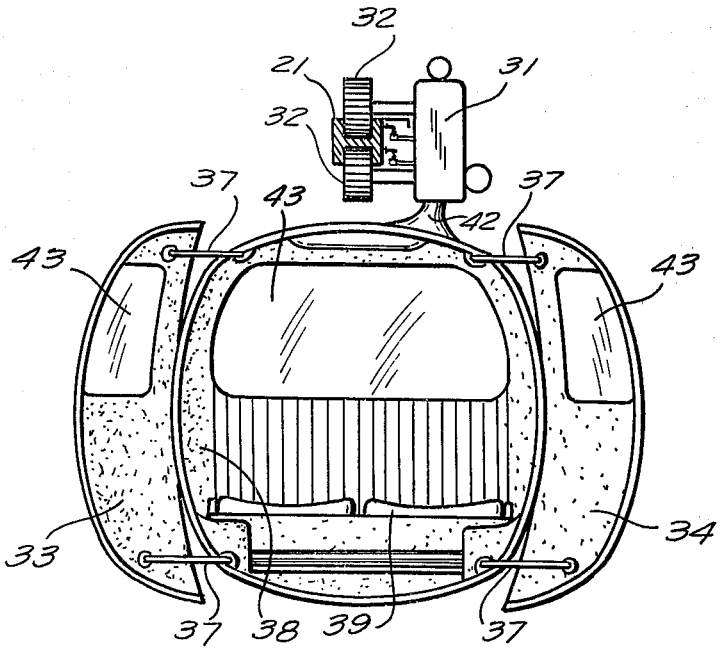
FIG. 5 is a front elevation view thereof.

Therefore, when the doors have been opened as indicated and the seats have been retracted, the vehicles can be nested within one another as depicted in FIGS. 3–5. The only limitation on the degree of nesting resides in the positioning and size of the drive and connector housings 31. As shown, these housings are brought into abutment during storage. It can be readily seen how storage space is minimized by the stacking feature since a plurality of vehicles 26 can be stored within the same space occupied by a single vehicle in the operable closed position as shown in FIG. 2. For use, all that need be done is the seat shifted to the operable position, the user climb into chamber 38, takes his position in the seat, close the doors and push an appropriate button to advance the most forward of the stacked and stored vehicles.

Another feature which should be particularly pointed out is the off-set mounting of housing 31 with respect to capsule 26. The integral mounting structure 42, as shown in FIG. 5, is oriented away from the central forward portion of capsule 26 so as to minimize the danger of passenger contact with the overhead power and drive structure associated with housing 31.

Appropriate windows 43 are provided in the vehicle, both in the door and fixed portions of the capsule so as to give the maximum amount of visibility to the rider about a 360° circumference. The windows do not interfere with the operation of the vehicle nor the storage capabilities of the vehicle.

Thus, the above objectives of the invention, among others, are effectively attained.

I claim:

1. A personalized rapid transit system comprising; an interconnected network of rails, support means to locate the rails in a predetermined three-dimensional pattern, a plurality of vehicles with each vehicle adapted to carry at least one person therein and having a configuration which facilitates the removable nesting of vehicles when not in use, each vehicle having a substantially hemispherical portion tapering from an enlarged open end to a rear end of lesser diameter than the opening in the open end, door means on the vehicle shiftable between a position closing the open end to a position exposing the open end and permitting at least the tapered rear end of another vehicle to be placed within the vehicle thereby permitting the vehicles to be stored partially within one another when not in use, and connector and drive means on each vehicle and connected to the network of rails so that the vehicle is suspended from the rail network and is guided and supported thereby during travel and storage.

2. The invention in accordance with claim 1 wherein the rail network includes street level portions, inclined portions and elevated horizontal portions including station areas and the network being adapted for passage through openings in a building thereby facilitating the arrangement of the network of rails for a maximum variety of transportation and paths.

3. The invention in accordance with claim 1 wherein the network of rails is a monorail system.

4. The invention in accordance with claim 1 wherein the drive means and connector means extend from the top of each vehicle and spaced from the center thereof to alleviate danger of passengers coming in contact with the drive and connector means.

5. A personalized rapid transit system comprising; an interconnected network of rails, support means to locate the rails in a predetermined three-dimensional pattern, a plurality of vehicles with each vehicle adapted to carry at least one person therein and having a configuration which facilitates the removable nesting of vehicles when not in use, the vehicles being stored partially within one another when not in use, connector and drive means on each vehicle and connected to the network of rails so that the vehicle is suspended from the rail network and is guided and supported thereby during travel and storage, a pair of adjacent doors being provided with each door having an outer configuration substantially in the shape of a spherical segment with the adjacent edges of the doors in abutment when the doors are closed and the distal edge of each door adjacent to the hemispherical portion when the doors are closed, the doors being pivotal to an open position wherein the doors are pivoted away from one another into overlapping relationship to the hemispherical portion of the vehicle to thereby provide an opening between the adjacent edges of the doors to permit entry or exit of a passenger from the vehicle and to facilitate nesting of one vehicle within the other.

6. The invention in accordance with claim 5 wherein each vehicle has a seat mounted therein for use by a passenger, the seat being shiftable from a horizontal operating position to a substantially vertical non-operating position which is desirable when nesting and storage of vehicles is to be accomplished.

7. The invention in accordance with claim 5 wherein windows are provided in the spherical portion of each vehicle and in the doors thereof to facilitate visibility for a passenger.

* * * * *